US005988086A

United States Patent [19]

Mitchell et al.

[11] Patent Number: 5,988,086

[45] Date of Patent: Nov. 23, 1999

[54] SAILBOAT AND METHODS

[75] Inventors: David N. Mitchell, Englewood; John W. Bradley, Littleton; James H. Keesling, Englewood, all of Colo.

[73] Assignee: Cerebral Technologies, Inc., Colo.

[21] Appl. No.: 09/031,502

[22] Filed: Feb. 26, 1998

[51] Int. Cl.[6] ..... B63B 35/00; B63H 9/08

[52] U.S. Cl. ..... 114/39.11; 114/39.29; 114/102.15; 114/102.19; 114/102.21

[58] Field of Search ..... 114/204, 102.1, 114/102.15, 102.19, 102.16, 102.18, 102.21, 111, 112, 223, 97, 98, 89, 94, 102.2, 39.11, 39.21, 39.29

[56] References Cited

U.S. PATENT DOCUMENTS

| | | | |
|---|---|---|---|
| 3,658,025 | 4/1972 | Hood et al. | 114/105 |
| 3,851,609 | 12/1974 | Stearn | 114/105 |
| 3,948,200 | 4/1976 | Hood et al. | 114/105 |
| 4,263,861 | 4/1981 | Vicard | 114/39 |
| 4,354,444 | 10/1982 | Puretic | 114/105 |
| 4,856,448 | 8/1989 | Peyman | 114/103 |
| 5,485,799 | 1/1996 | Julien | 114/103 |
| 5,603,276 | 2/1997 | Julien | 114/39.1 |

*Primary Examiner*—Sherman Basinger
*Attorney, Agent, or Firm*—Townsend and Townsend and Crew LLP

[57] ABSTRACT

The invention provides various improved sailboats and methods for their use. In one exemplary embodiment, a sailboat comprises a hull and a deck that is operably attached to the hull. The deck has a longitudinal axis extending along its center. A mast is generally aligned with the longitudinal axis, and a luff cable is coupled to the mast and the deck. The luff cable is movable relative to the longitudinal axis. Further, a foresail is coupled to the luff cable such that at least a portion of the foresail is movable relative to the longitudinal axis upon movement of the luff cable.

43 Claims, 13 Drawing Sheets

SAILBOAT AND METHODS

BACKGROUND OF THE INVENTION

The invention relates generally to the field of sailing. More specifically, the invention relates to the operation and management of sails on sailboats.

Sailing has long been a popular sport. One particular type of sailboat which is of interest to the present invention is illustrated generally in FIG. 1. It is identified by referenced numeral 10. Sailboat 10 comprises a hull (not shown) and a deck 12 disposed on top of the hull. At a back end of boat 10 is the stern 14, while at the front end is the fore peak 16. Extending between fore peak 16 and stern 14 (i.e., along a center of deck 12) is a central axis 18. Central axis 18 divides sailboat 10 into port side 20 and a starboard side 22. At the front end of sailboat 10 is the bow 24.

Extending generally vertically upward from deck 12 is a mast 26. Mast 26 is aligned with central axis 18 and is held in place by a forestay or headstay 28, a backstay 30, and pair of shrouds 32 and 34. Forestay 28 is attached to deck 12 at a stemhead fitting 36 which lies on central axis 18. Since the opposite end of forestay 28 is attached to mast 26, forestay 28 is generally parallel with central axis 18. Backstay 30 is attached to deck 12 by a backstay fitting 38. At its opposite end, backstay 30 is attached to mast 26 at a masthead 40.

The current method for rigging a foresail, such as a jib, spinnaker, and the like, on sailboat 10 is by use of forestay 28. The foresail is raised along forestay 28 which in turn serves as the axis point for rotating the foresail. However, because forestay 28 has the additional function of securing mast 26, forestay 28 cannot be moved from its securing points on mast 26 and deck 12. Although a variety of methods may be employed to attach the foresail to headstay 28, headstay 28 remains the axis point of the foresail. Since headstay 28 is the attachment point of the foresail, the axis of rotation of the foresail is always fixed at central axis 18. Such a configuration can limit the usefulness of the foresail and its cooperation with the main sail. For example, in some cases the main sail may block a significant amount of wind from the foresail to limit the speed of the sail boat.

Another drawback to sailboat 10 is the difficulty encountered by a sailor when changing the foresail. Changing of the foresail with current rigging equipment requires one more of the crew members to exit a cabin 42 and proceed onto bow 24 so that the foresail can be removed from forestay 28 and replaced with another sail. However, the addition of one or more crew members on the bow 24 will cause a change in the attitude of the boat in the water, thereby slowing the speed of the boat. Another disadvantage is that it may become dangerous for crew members to be positioned on bow 24, particularly when another sail also occupies bow 24. A further disadvantage is that it is time consuming to have a crew member exit cabin 42 and proceed to forestay 28 to change the sail.

Hence, it would be desirable to provide improved sailboats which will greatly reduce or eliminate the problems associated with prior art sailboats. For example, in one embodiment, it would be desirable to provide a sailboat having a more versatile foresail arrangement and where the use of the foresail and its cooperation with the main sail were optimized. It would further be desirable to provide a more efficient way to manage the foresail, including providing an easy and convenient way to raise and lower the foresail.

SUMMARY OF THE INVENTION

The invention provides improved sailboats and methods for their construction and use. One important feature of at least some embodiments of the invention is that the foresail is provided with an axis of rotation that can be located essentially anywhere on the bow of the boat. The axis of rotation of the foresail will preferably be variable so that its location may be varied both toward and away from central axis as well as in the fore and aft directions. In this way, both the head and the tack of the foresail may be moved away from the longitudinal axis on both sides of the boat, regardless of the direction of the wind. As such, both the head and the tack may be moved to a windward side of the sailboat such that wind may engage the foresail and not be substantially blocked by the mainsail when traveling downwind. Preferably, such features will be provided by coupling the foresail to a wire, cable, line or the like which is separate from the forestay or headstay. In this way, the axis of rotation of the foresail may be located away from the central axis of the boat. Further, various tracks may be provided on the boat or the mast to allow for the location of the cable to which the foresail is attached to be varied.

In one exemplary embodiment, the invention provides a sailboat which comprises a hull and a deck which is operably attached to the hull. The deck includes a longitudinal axis which extends along a center of the deck. A mast is further provided and is generally aligned with the longitudinal axis. A luff cable is coupled to the mast and the deck, with the luff cable being movable relative to the longitudinal axis. Further, a foresail is coupled to the luff cable such that at least a portion of the foresail is movable relative to the longitudinal axis upon movement of the luff cable.

The luff cable is preferably coupled to the mast and the deck such that the luff cable can be moved toward and away from the central axis, in the fore and aft directions, or both. In this way, the location of the rotational axis of the foresail may be positioned essentially anywhere fore of the mast. With such a configuration, the speed of the sailboat may be increased regardless of the direction of the boat in relation to the wind.

Typically, the foresail includes a head, a tack, and a clue, with the foresail being coupled to a luff cable between the head and the tack. Preferably, the luff cable is movably coupled to the deck to allow the tack to be movable relative to the longitudinal axis. In another aspect, the luff cable may be movably coupled to the mast to allow the head of the foresail to be movable relative to the longitudinal axis.

In one particularly preferable aspect, a track is operably attached to the deck, with at least a portion of the track being at an angle relative to the longitudinal axis. The luff cable is coupled to the track so that the location of the luff cable along the bow of the deck may be varied. The track may be disposed at various locations along the deck and may have various configurations, including straight tracks, angled tracks, curved tracks and the like. For example, the track may be conveniently disposed about a periphery of the deck. Typically, a carriage will be coupled to the track, with the luff cable being coupled to the carriage.

In another exemplary aspect, a track is also operably attached to the mast to raise and lower the luff cable relative to the mast. An adjustment mechanism is preferably coupled to the mast track to vary the location of the luff cable relative to the longitudinal axis. For example, the adjustment mechanism may comprise a cross member having a track to which the luff cable is coupled. The cross member is movably coupled to the mast track so that the cross member may be raised and lowered. To move the luff cable toward or away from the central axis, the luff cable is simply moved along the track of the cross member. Alternatively, the adjustment mechanism may comprise a pivotable strut which is coupled to the mast track. In this way, the luff cable may be moved in a variety of directions relative to the mast.

The foresail is preferably raised by moving the luff cable along the deck in a direction generally toward the fore peak while also moving the luff cable up the mast until tension is provided to the luff cable. Once the sail is raised, the location of the luff cable may be varied along the bow of the deck to vary the location of the tack. Optionally, the location of the luff cable may also be varied relative to the mast to vary the location of the head of the foresail. As with conventional sailboats, the location of the clue may also be varied as is known in the art. In this way, an almost infinite variety of sail locations may be provided to optimize the cooperation of the foresail with the main sail. Advantageously, the deck track and the mast track may terminate in the vicinity of the cockpit or cabin so that the foresail may be raised or lowered while the crew remain within or near the cabin area. In this way, excessive weight is not transferred to the bow of the boat. Further, the need for placing crew members on the bow of the deck is eliminated.

In another exemplary embodiment, the invention provides a sailboat which comprises a hull and a deck that is operably attached to the hull. The deck has a longitudinal axis that extends along the center of the deck. A mast is generally aligned with the longitudinal axis. Further, at least two tracks are disposed on the deck and on the mast. In this way, each of the tracks may be used to raise or lower a different foresail. In this manner, operation of the sailboat may be optimized since one sail may remain raised while raising another sail. Once the second sail is raised, the first sail may be lowered and removed.

Preferably, a luff cable is attached to each of the tracks and is coupled to one of the foresails. In this way, each foresail may be raised by moving the luff cable along one of the deck tracks and up one of the mast tracks. In another aspect, the deck tracks are disposed on opposite sides of the longitudinal axis. In a further aspect, at least a portion of the deck tracks are disposed at an angle relative to the longitudinal axis. In this way, the foresail may be moved both toward and away from the longitudinal axis so that the rotational axis of the foresail may be varied. In still another aspect, an adjustable strut or cross member may be coupled to at least one of the mast tracks so that the luff cable may be moved either toward or away from the mast when coupled to the adjustable strut or cross member. Conveniently, the mast track or tracks and the deck track or tracks may begin near the cockpit so that the various foresails may be raised and lowered while the crew remain in or near the cabin area.

The invention further provides an exemplary method for retrofitting a sailboat to accommodate a foresail having a variable foresail axis. According to the method, a track is coupled to a deck of the sailboat as well as to a mast of the sailboat. In this way, the foresail may be raised and lowered by coupling the foresail to a luff cable and moving the luff cable along the deck track and the mast track. Preferably, at least a portion of the deck track is at an angle relative to a longitudinal axis of the boat so that the foresail may be movable relative to the longitudinal axis. Optionally, two or more deck tracks may be coupled to both the deck and the mast to allow separate foresails to be separately raised and lowered.

DESCRIPTION OF THE PREFERRED EMBODIMENT

The invention provides exemplary sailboats and methods for their construction and use. One important feature of the invention is that it provides a way to vary the location of the rotational axis of the foresail relative to the sailboat. In this way, the use of the foresail and its cooperation with the main sail may be optimized so that boat speed may be increased regardless of wind direction. In certain preferred embodiments, the location of the rotational axis of the foresail is made variable by attaching the foresail to a luff cable, wire, line and the like and varying the attachment points of the luff cable on the deck and/or the mast. In this way, the rotation of the axis of the foresail may be placed in an almost infinite variety of orientations simply by moving the luff cable to different locations relative to the deck and/or relative to the mast. More specifically, the attachment points of the luff cable to the mast and the deck may be moved either fore, aft, toward, or away from the central axis of the sailboat to vary the orientation and location of the rotational axis of the foresail.

Another important feature of the invention is that it provides a convenient way to raise a foresail. This is preferably accomplished by providing a track along the deck and a track along the mast, with the two tracks terminating near the cockpit or cabin of the sailboat. In this way, the luff cable (having the foresail attached) can be moved along the deck toward the fore peak and up the mast to provide tension to the luff cable and raise the foresail. In this manner, a sailor need not exit the cabin or cockpit to raise or lower the foresail. Further, such a configuration allows the foresail to be raised and lowered more efficiently and more safely.

Still another important feature of the invention is that the sailboats may be provided with two or more sets of tracks on the deck and the mast. In this way, two or more sails may be separately operated. For example, one foresail may remained raised while preparing to raise another foresail. Once the other foresail is raised, the first foresail may be lowered. In this manner, the sailboat will essentially always have a foresail available for operation.

Figure 1:
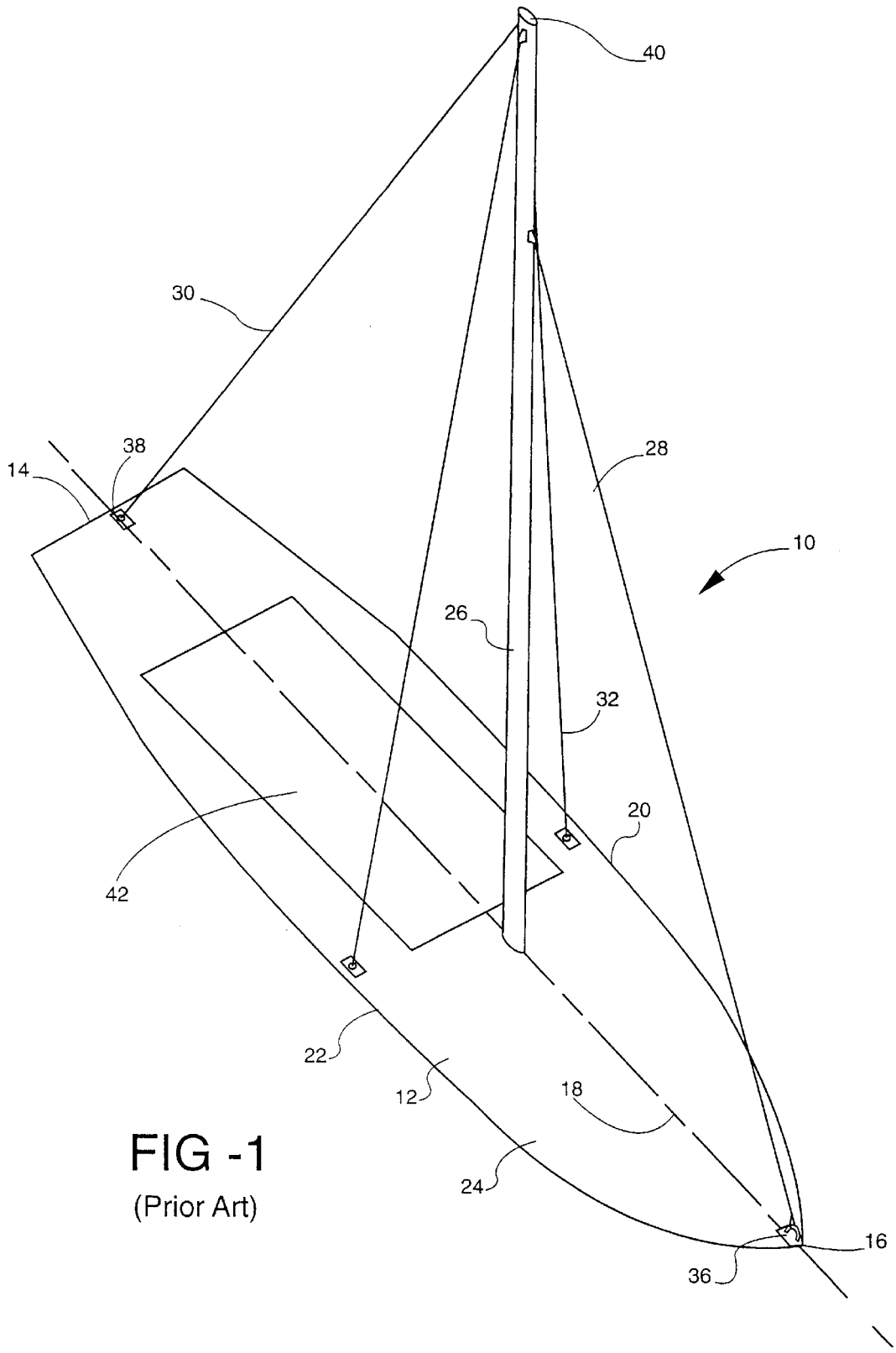
FIG -1 (Prior Art)
FIG. 1 illustrates a prior art sailboat having a mast secured by a forestay and a backstay which are aligned with a central axis of the sailboat.
Figure 2:
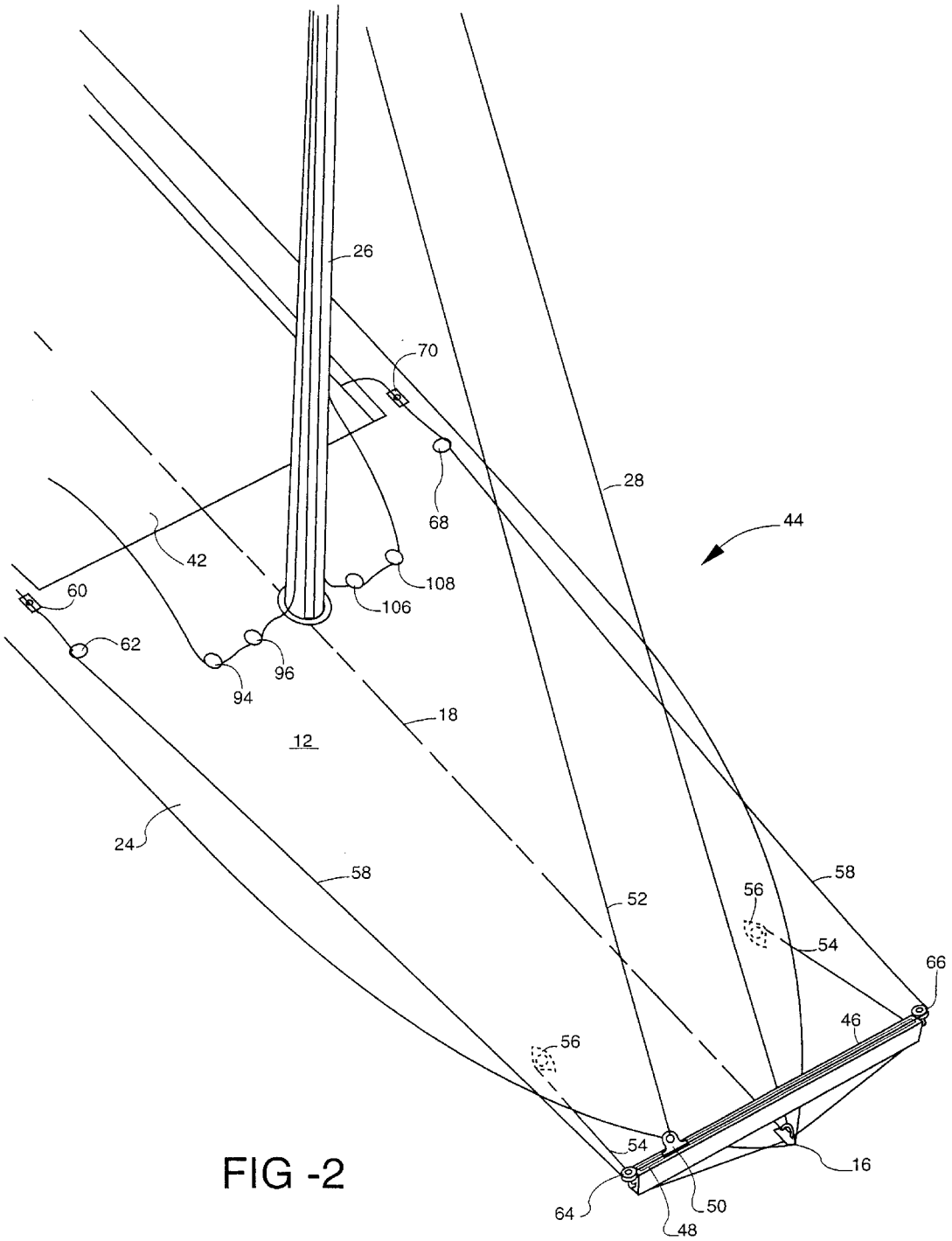
FIG. 2 illustrates a bow of a sailboat having a track to vary the location of a luff cable to which a foresail may be attached according to the invention.

Referring now to FIG. 2, an exemplary embodiment of a sailboat 44 will be described. Sailboat 44 is constructed of various elements that are essentially identical to sailboat 10 of FIG. 1. For convenience of discussion, identical elements will be described using the same reference numerals as used to describe sailboat 10.

Attached to deck 12 near forepeak 16 is a support 46 having a track 48. Track 48 as well as the other tracks described herein may be any one of a variety of commercially available tracks, such as those commercially available from Harken, Inc. Track 48 is generally perpendicular to central axis 18, although track 48 could be arranged at other angles relative to central axis 18 and can also be provided with other geometries, such as curved, angled, elliptical, and the like. Coupled to track 48 is a carriage 50 which is movable along track 48. Coupled to carriage 50 is a luff cable 52. Although not shown, luff cable 52 will typically have a foresail operably attached thereto. In this way, luff cable 52 serves as the rotational axis for the foresail. As carriage 50 is moved along track 48, luff cable 52 is also moved to move the location of the rotational axis of the foresail. Conveniently, support 46 is secured to sailboat 44 by guy wires 54 which in turn are coupled to a pair of chain plates 56 (shown in phantom line) on the hull of the sailboat.

Carriage 50 is moved along track 48 by operating a control cable 58. Control cable 58 extends from cabin 42, around a cleat 60, adjacent a sheave 62 on deck 12, around another sheave 64 on support 46, and then to carriage 50. From carriage 50, control cable 58 extends around another sheave 66, to a sheave 68, around a cleat 70, and back into cabin 42. In this manner, carriage 50 may be moved along track 48 simply by unwrapping control cable 58 from cleats 60 and 70 and pulling on either end of control cable 58.

Figure 3:
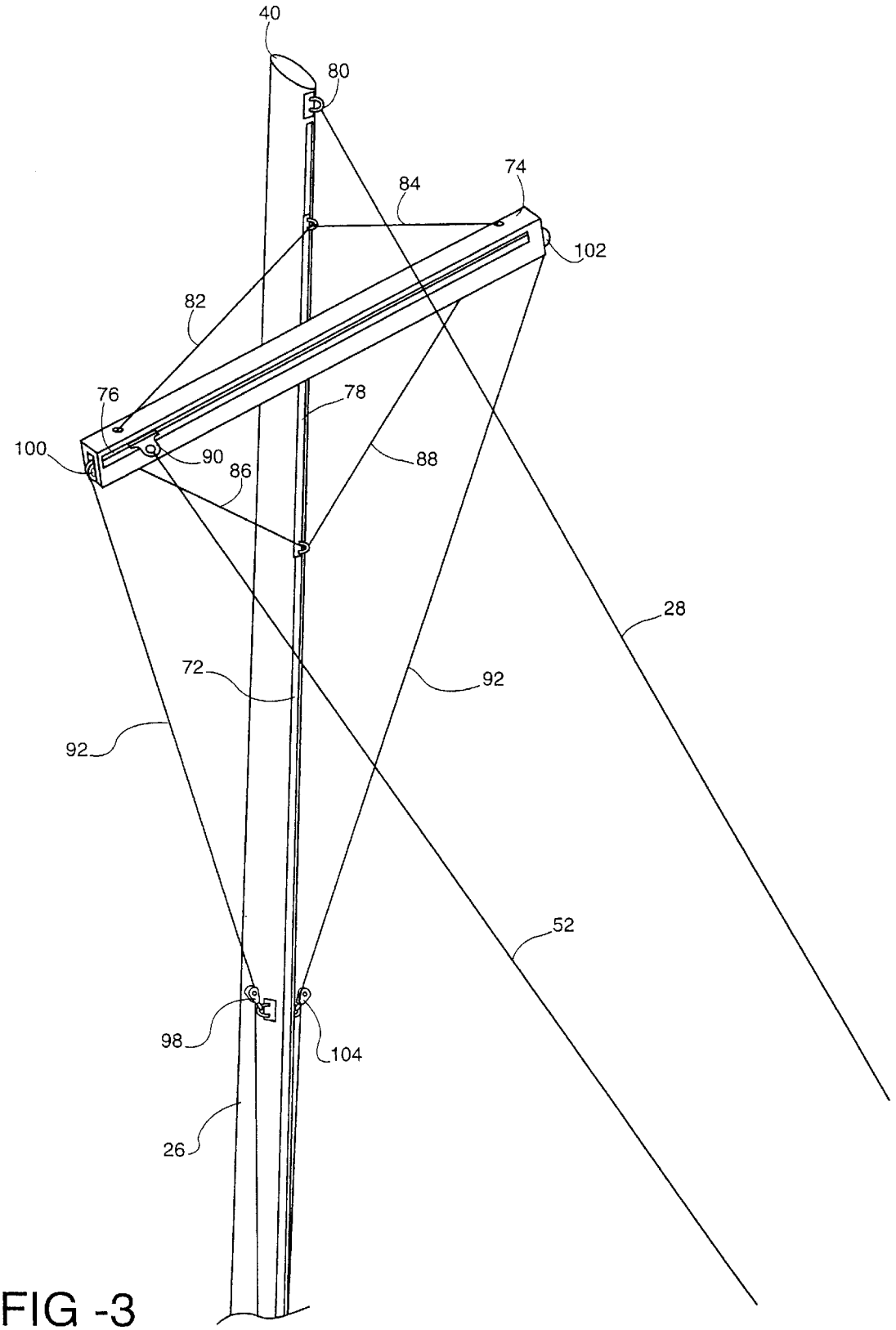
FIG. 3 illustrates a top end of the mast of the sailboat of FIG. 2 having a cross member with a track for varying the location of the luff cable relative to the mast according to the invention.

As best shown in FIGS. 2 and 3, mast 26 includes a track 72 which allows luff cable 52 to be raised and lowered as described hereinafter. Coupled to track 72 is a cross-member 74 which also includes a track 76. Cross member 74 is movable along track 72 so that it may be moved up and down mast 26. Cross-member 74 is coupled to track 72 by an elongate carriage 78 which moves along track 72. A sheave 80 is provided at masthead 40 so that a cable (not shown) may be used to lift cross-member 74. To lower cross-member 74, the cable is simply released, allowing cross-member 74 to move down track 72 by force of gravity. Conveniently, a set of guy wires 82–88 are provided to secure cross-member 74 to carriage 78. In this way, cross-member 74 is stabilized relative to mast 26.

Coupled to track 76 of cross-member 74 is a carriage 90. Attached to carriage 90 is luff cable 52. As carriage 90 is moved along track 76, the horizontal location of luff cable 52 is varied. As previously described, the other end of luff cable 52 is coupled to carriage 50 on support 46 (see FIG. 2). In this way, the position of luff cable 52 relative to the sailboat may be varied either by moving carriage 50 or carriage 90 so that a wide variety of orientations for luff cable 52 may be obtained. In this manner, the rotational axis of the foresail can be moved to a variety of locations in an easy and convenient manner.

Still referring to FIGS. 2 and 3, carriage 90 is moved along track 76 by use of a control cable 92. Control cable 92 initiates within cabin 42 and extends around a pair sheaves 94 and 96 where it is directed upward on mast 26. Control cable 92 is coupled to mast 26 by a sheave 98. From sheave 98, control cable 92 extends to a sheave 100 on cross-member 74. Control cable 92 is then coupled to carriage 90 and then extends to a sheave 102 at an opposite end of cross-member 74. Finally, control cable 92 passes around sheaves 104–108 until terminating within cabin 42. In this manner, a sailor within cabin 42 may move carriage 90 along track 76 by simply pulling on either end of control cable 92 while remaining within cabin 42.

Figure 4:
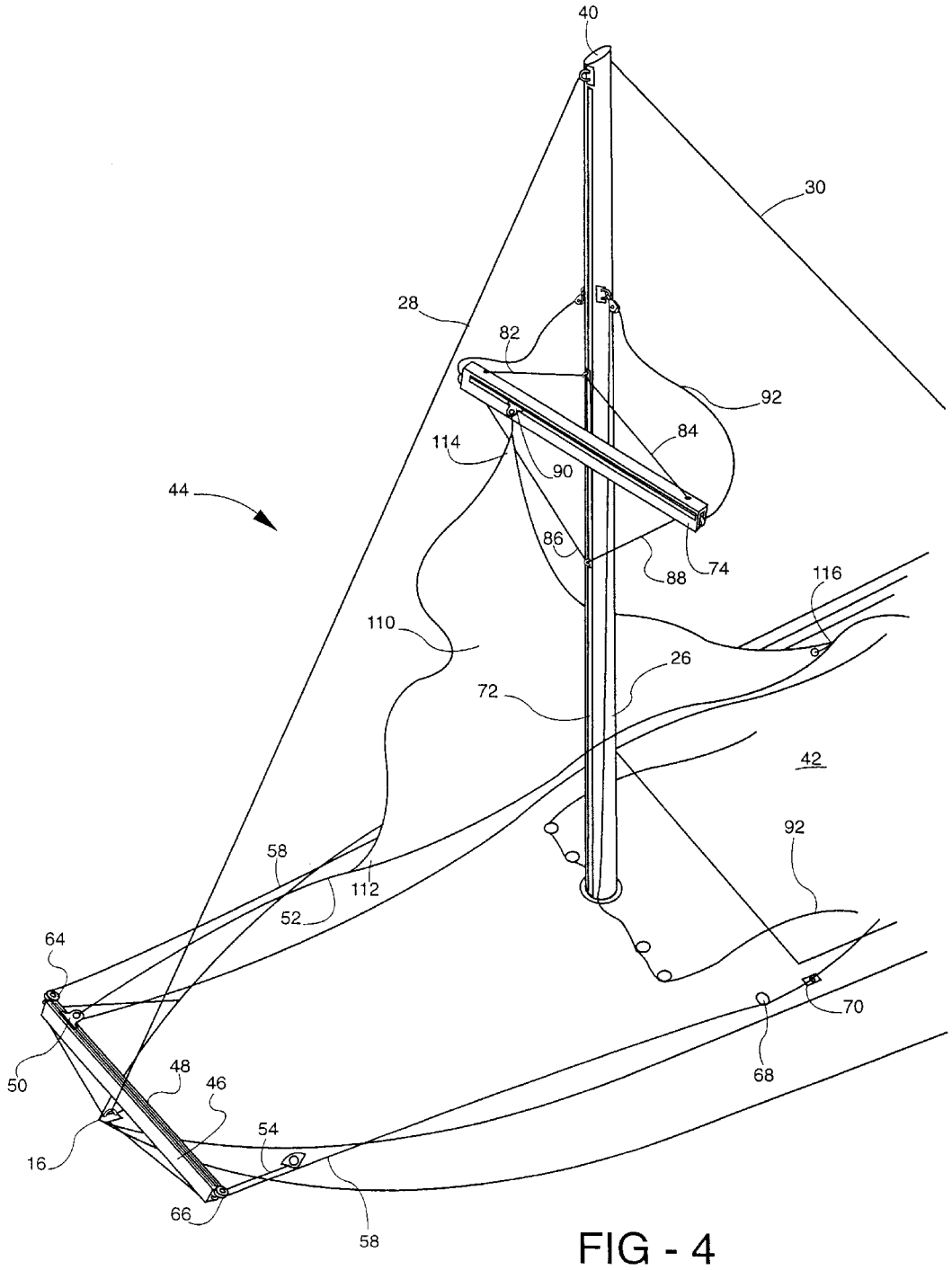
FIG. 4 illustrates the sailboat of FIGS. 2 and 3 showing a method for raising a foresail using the luff cable according to the invention.
Figure 5:
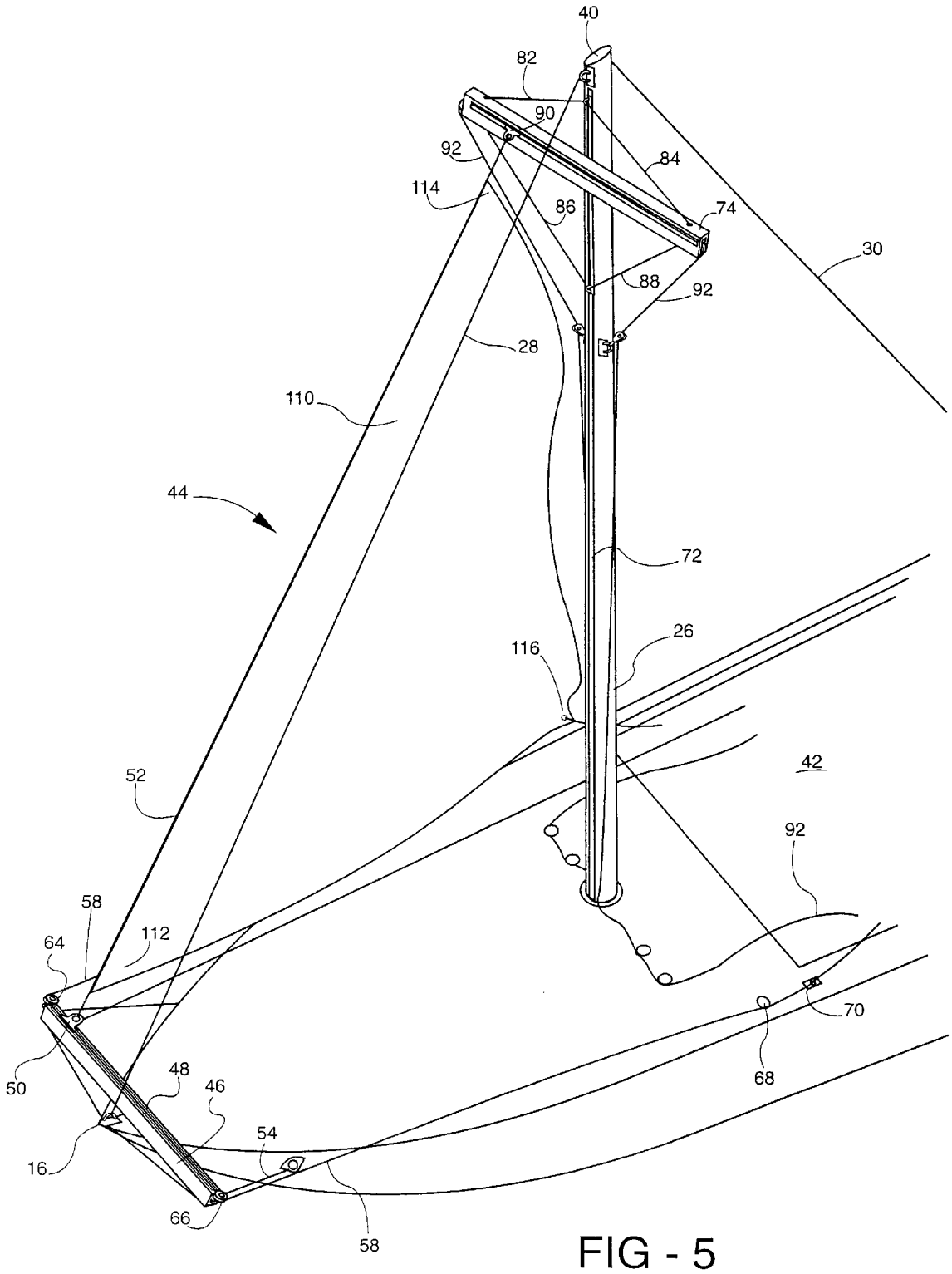
FIG. 5 illustrates the sailboat of FIG. 4 when the foresail is completely raised.

Referring now to FIGS. 4 and 5, an exemplary method for raising a foresail 110 on sailboat 44 will be described. Foresail 110 includes a tack 112, a head 114, and a clew 116. Luff cable 52 is attached to foresail 110 between tack 112 and head 114 as shown. Luff cable 52 is initially threaded through carriage 50 and brought back within cabin 42. The other end of luff cable 52 is coupled to carriage 90. Preferably, cross-member 74 is lowered along track 72 so that luff cable 52 may be coupled to carriage 90 from within cabin 42. Luff cable 52 is then pulled from within cabin 42 to move tack 112 toward carriage 50. Cross-member 74 is also raised along track 72 to move head 114 upwardly along mast 26. This process is continued until luff cable 52 has the desired tension as illustrated in FIG. 5. At any time, carriage 50 and/or carriage 90 may be moved to change the orientation of luff cable 52 and foresail 110. As previously described, the orientation of luff cable 52 may be varied within the cabin by manipulating control cable 58 and/or control cable 92.

Figure 6:
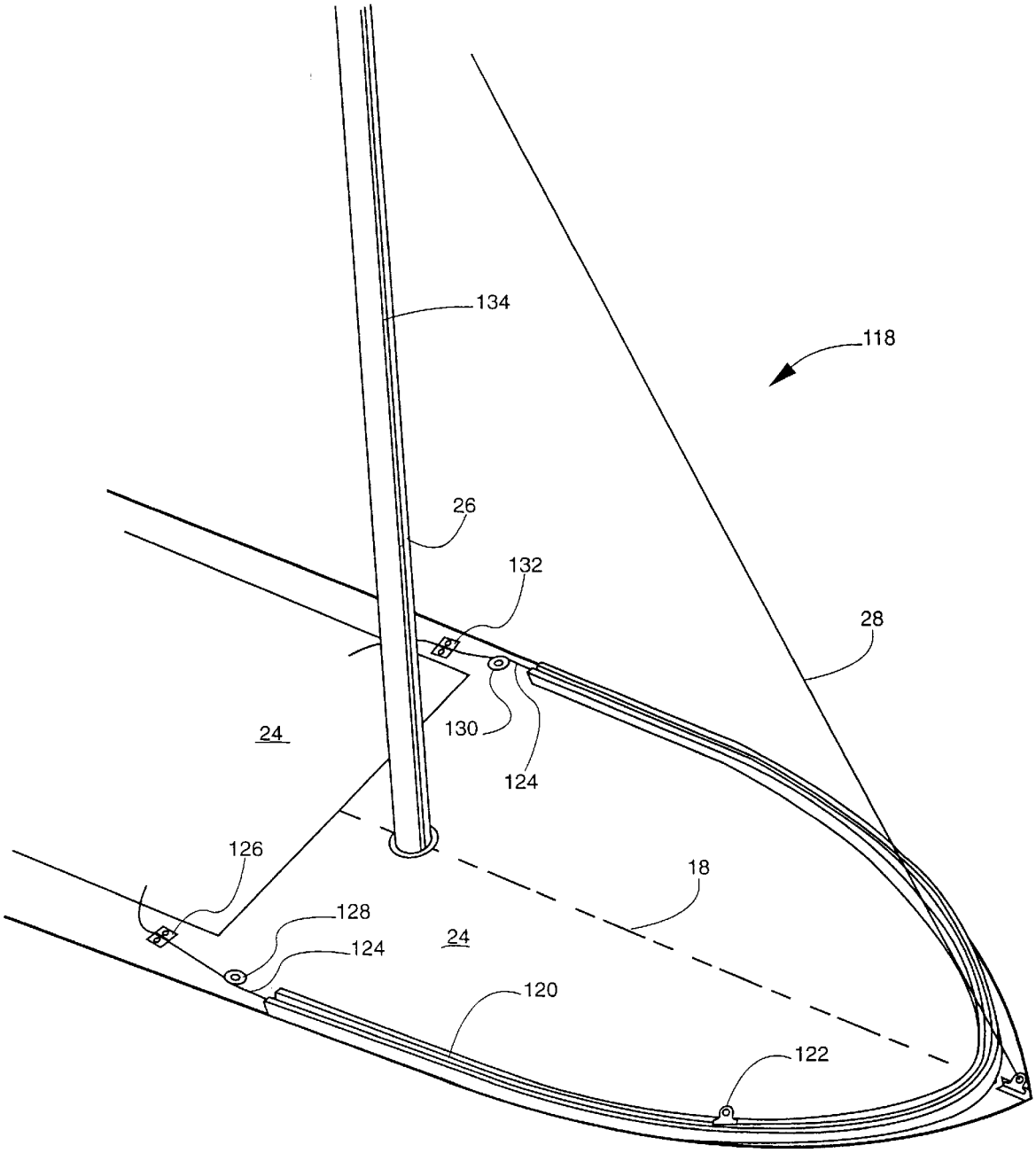
FIG. 6 illustrates another embodiment of a sailboat having a track disposed about a periphery of the deck to vary the location of a luff cable to which a foresail may be operably attached according to the invention.

Referring to FIG. 6, an alternative embodiment of a sailboat 118 will be described. Sailboat 118 includes a track 120 which extends about the periphery of bow 24. Coupled to track 120 is a carriage 122 to which a luff cable may be attached to vary the rotational axis of a foresail similar to that previously described with sailboat 44.

Carriage 122 is moved along track 120 by use of a control cable 124. Control cable 124 extends from cabin 24, along a cleat 126, along a sheave 128, and to carriage 122. From carriage 122, control cable 124 runs back along a sheave 130 and a cleat 132 where it terminates within cabin 24. In this way, a sailor may move carriage 122 along track 120 by pulling on control cable 124 while remaining within cabin 24.

Mast 26 includes a track 134 which is used to raise and lower the other end of the luff cable similar to sailboat 44. Instead of employing a cross-member to raise the luff cable on mast 26, a simple carriage may be coupled to track 134 to raise or lower the luff cable (not shown). As another alternative, an adjustable strut 136 (see FIGS. 7 and 12) may be employed to allow the location of the luff cable to be varied relative to the mast. Adjustable strut 136 will be described in greater detail with reference to FIG. 12.

Figure 7:
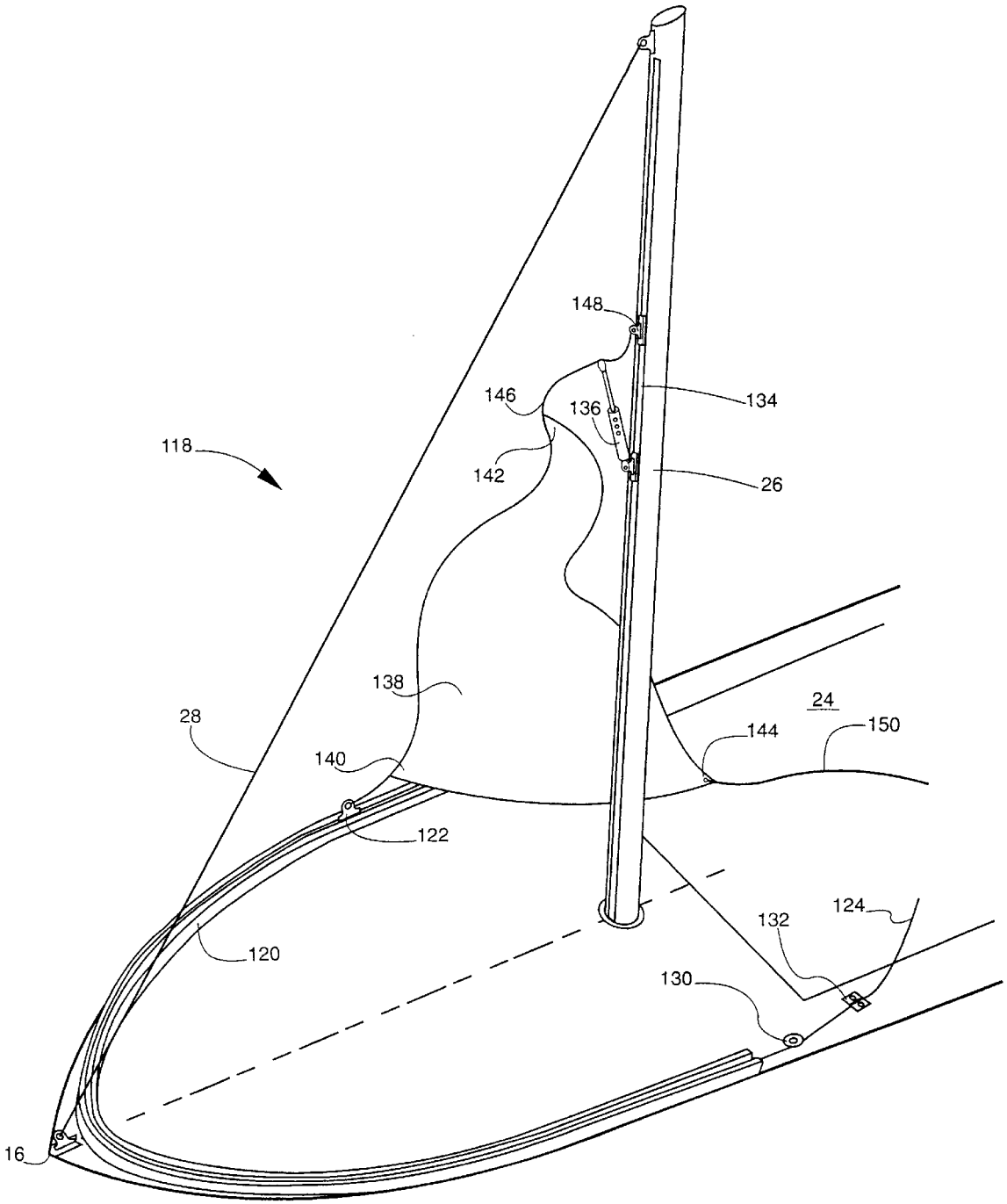
FIGS. 7 and 8 illustrate an exemplary method for raising a foresail using the luff cable and track of FIG. 6.
Figure 8:
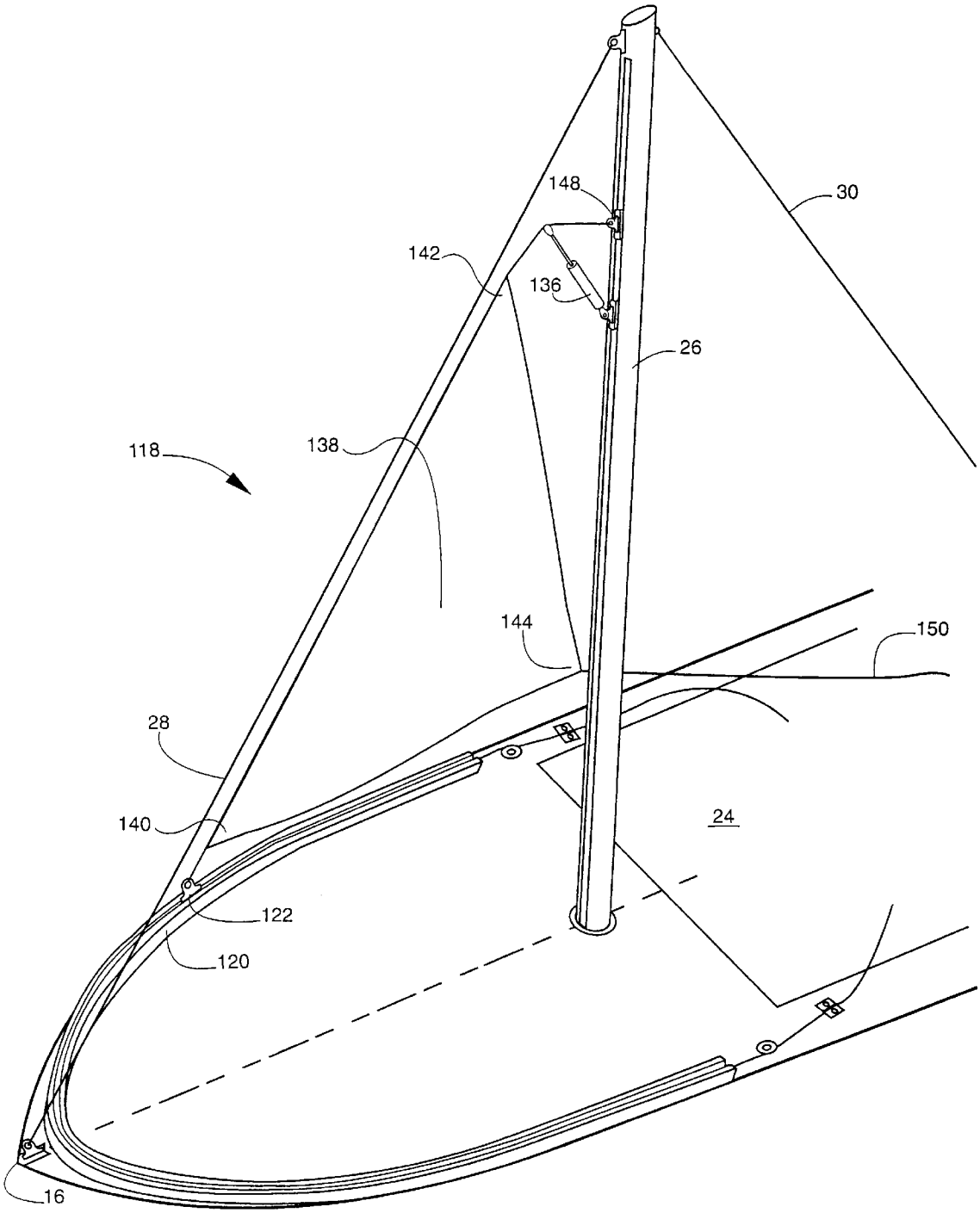

Referring now to FIGS. 7 and 8, an exemplary method for raising a foresail 138 on sailboat 118 will be described. Foresail 138 includes a tack 140, a head 142, and a clew 144. Foresail 138 is attached to a luff cable 146 between head 142 and tack 140. Luff cable 146 is attached to carriage 122, preferably while carriage 122 is dislocated near sheave 128 or sheave 130. In this way, a sailor need not exit cabin 24 in order to attach luff cable 146 to carriage 122. The other end of luff cable 146 (i.e., near head 142) is attached to a carriage 148 which is coupled to track 134. Luff cable 146 is preferably attached to carriage 148 while carriage 148 is lowered so that coupling or attachment may occur from within cabin 24. Control cable 124 is then pulled from within cabin 24 to move carriage 122 toward forepeak 16 shown in FIG. 8. Carriage 122 may be stopped anywhere along track 120 depending on where it is desired to locate foresail 138. Carriage 148 is also raised up track 134 until proper tension is provided in luff cable 146. Carriage 148 is raised using a cable (not shown) which runs the length of mast 26. As described in greater detail with reference to FIG. 12, adjustable strut 136 allows for the location of head 142 to be varied relative to mast 26. In this way, luff cable 146 may be placed in a wide variety of orientations so that the rotational axis of foresail 138 may be greatly varied. Further, a line 150 is attached to clew 144 as is known in the art to vary the location of clew 144.

Figure 9:
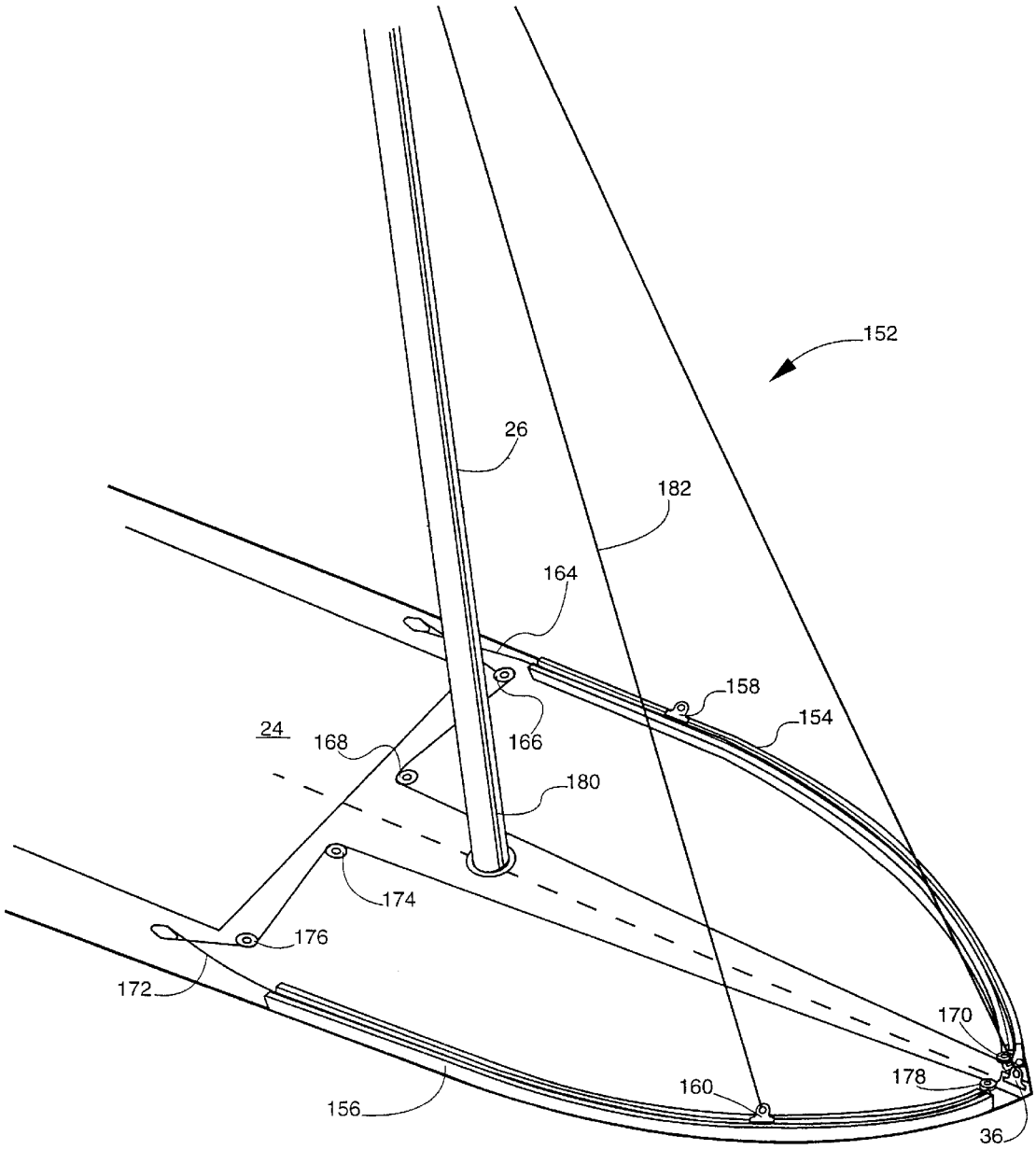
FIG. 9 illustrates another exemplary embodiment of a sailboat having a track disposed on the port side and a track disposed on the starboard side to which a luff cable may be coupled according to the invention.

Referring now to FIG. 9, still another embodiment of a sailboat 152 will be described. Sailboat 152 includes a port track 154 and a starboard track 156. Coupled to port track 154 is a carriage 158, and coupled to starboard track 156 is a carriage 160. In this manner, a luff cable 182 may be attached either to carriage 158 or carriage 160. With this arrangement, the rotational axis of the foresail may be varied on the port side using carriage 158 or on the starboard side using carriage 160. Further, use of two separate tracks allows for two foresails to be separately raised and lowered in a manner similar to that described hereinafter with reference to FIG. 11.

Carriage 158 is moved along track 154 using a control cable 164. Cable 164 is routed around a pair of turning blocks 166 and 168 and around a sheave 170. Similarly, carriage 160 is moved by a control cable 172 which is routed around a pair of turning blocks 174, 176 and a sheave 178. In this way, either control cable 164 or control cable 172 may be operated from within cockpit 24 to move the rotational axis of the foresail. Mast 26 includes a track 180 for raising or lowering the luff cable 182 in a manner similar to that described with previous embodiments.

Figure 10:
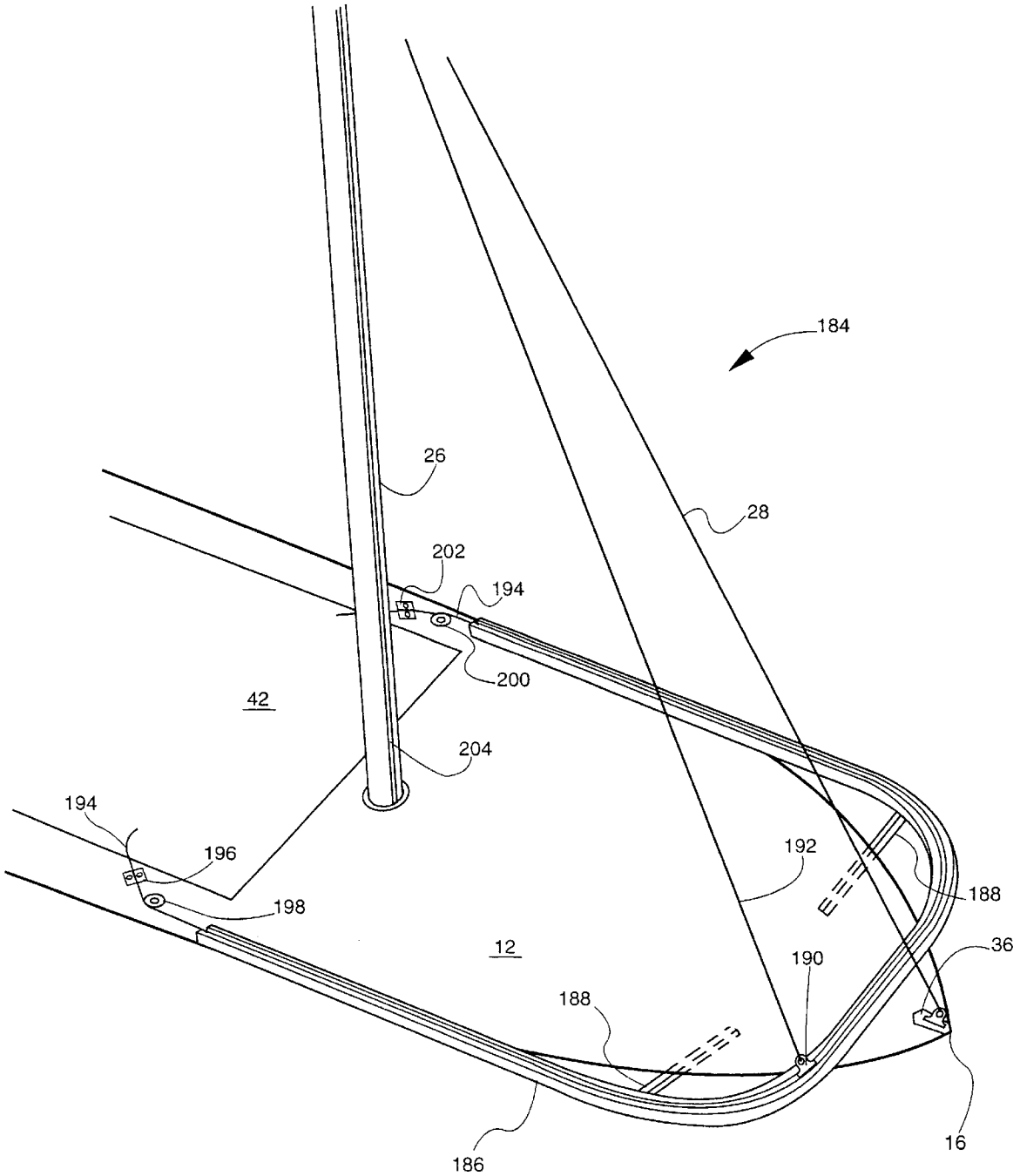
FIG. 10 illustrates still another embodiment of a sailboat having a track for adjusting the location of a luff cable to which a foresail may be attached according to the invention.

Referring to FIG. 10, still another embodiment of a sailboat 184 will be described. Sailboat 184 includes a track 186 that extends beyond the deck 12. Track 186 is supported by a pair of supports 188. Coupled to track 186 is a carriage 190 which in turn is coupled to a luff cable 192. As with other embodiments, carriage 190 may be moved about track 186 to vary the rotational axis of the foresail. Carriage 190 is moved along track 186 by operating a control cable 194. Control cable 194 begins in cabin 24 and extends along a cleat 196 and a sheave 198 before reaching carriage 190. Control cable 194 then extends past a sheave 200, along a cleat 202 and back into cabin 24. In this way, carriage 190 may be moved from within cabin 24. Mast 26 includes a track 204 for raising or lowering the other end of control cable 194 in a manner similar to that described with the previous embodiments.

Figure 11:
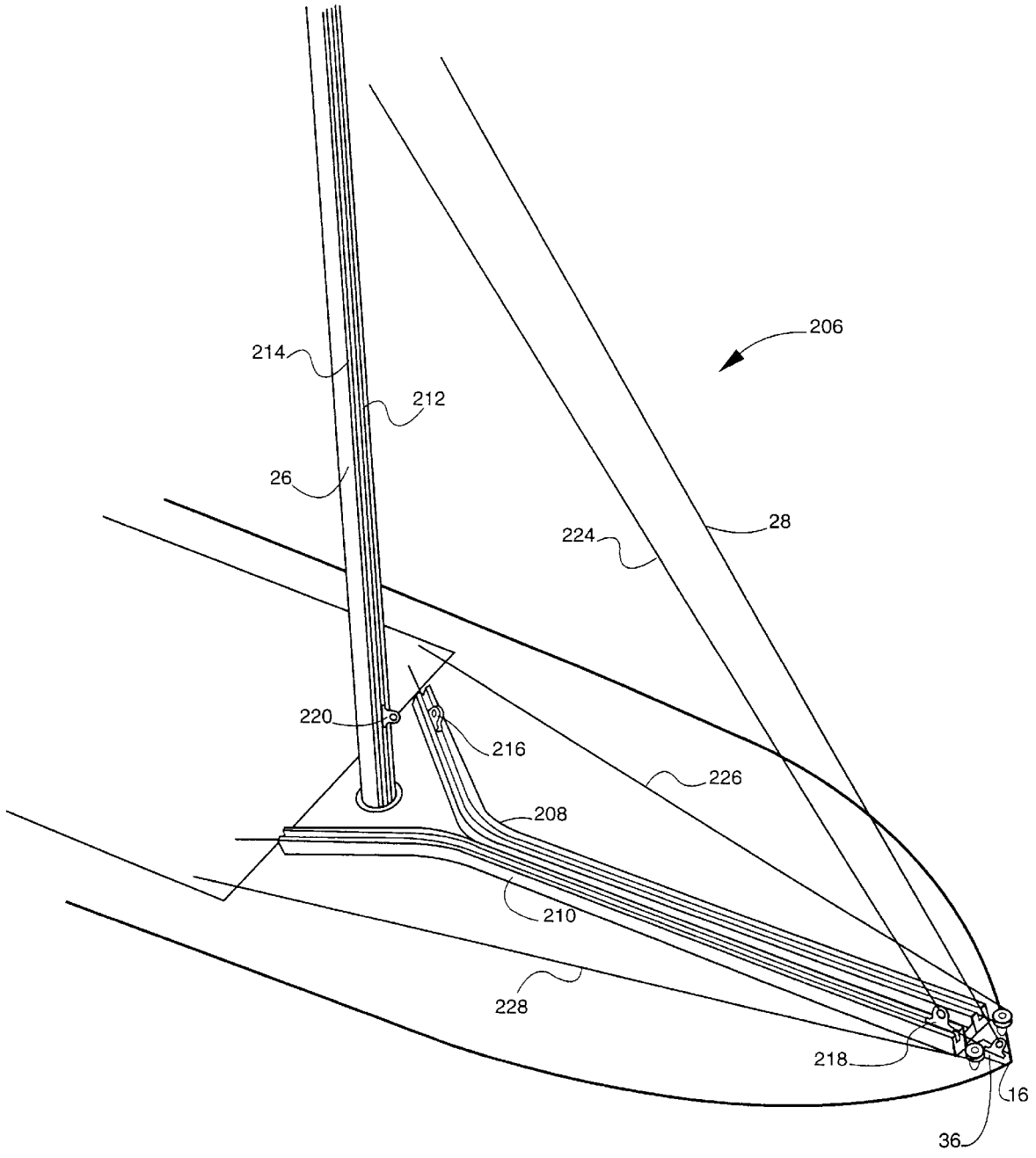
FIG. 11 illustrates still yet another embodiment of a sailboat having a pair of tracks on the deck and a pair of tracks on the mast to allow two foresails to be separately raised and lowered according to the invention.

Referring to FIG. 11, still yet another embodiment of a sailboat 206 will be described. Sailboat 206 includes a pair of deck tracks 208, 210 and a pair of mast tracks 212, 214. Coupled to each of tracks 208–214 is a carriage 216–222, respectively (with carriage 222 being illustrated in FIG. 12). Carriage 216 operates in cooperation with carriage 220 to raise a foresail that is attached to a luff cable (not shown). Similarly, carriage 218 works in combination with carriage 222 to raise and lower a foresail using a luff cable 224. In this way, two sails may be separately raised and lowered while remaining within cabin 24. Such a system is particularly advantageous when changing sails since one sail may remain raised while the other is loaded onto the carriages. Once the second sail is raised, the first sail may be lowered so that at least one foresail is operating at all times. Further, although not shown, the orientation of the deck tracks may be varied along deck 12 so that the rotational axis of the foresail may be varied as described in previous embodiments.

Carriage 216 is moved along track 208 by a control cable 226 while carriage 218 is moved along track 210 by a control cable 228. Carriages 220 and 222 are raised and lowered using control cables (not shown) which may be positioned about a sheave disposed on mast 26.

Figure 12:
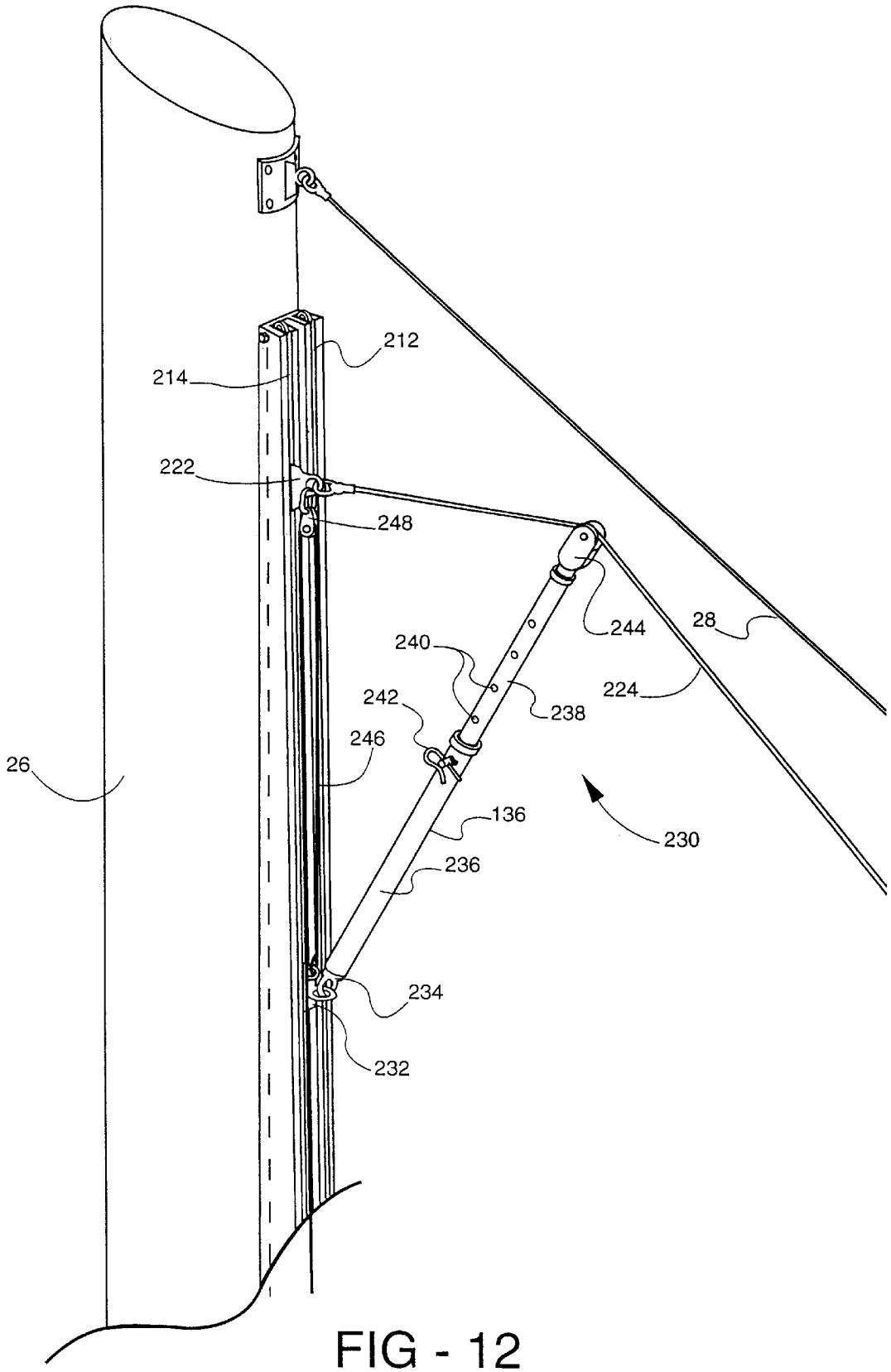
FIG. 12 illustrates a top end of the mast of FIG. 11 showing an adjustable strut to allow variation in the location of the luff cable relative to the mast according to the invention.

Referring now to FIG. 12, an adjustment mechanism 230 for adjusting the location of luff cable 224 will be described. Adjustment mechanism 230 comprises adjustable strut 136 having a loop 234 which is coupled to a carriage 232 on track 214. In this way, strut 136 may be pivoted about a wide variety of angles relative to mast 26. Adjustable strut 136 comprises a tubular body 236 and a shaft 238. Shaft 238 is provided with a plurality of holes 240 into which a pin 242 may be placed to vary the length of strut 136. In this way, the amount of tension supplied to luff cable 224 may be varied. Connected to shaft 238 is a pulley 244 upon which luff cable 224 is guided.

Carriage 222 is connected to carriage 232 by a control cable 246. Control cable 246 passes around a pulley 248 so that the distance between carriages 222 and 232 may be varied by pulling on control cable 246 while remaining within cabin 24. Although not shown, other control cables may be provided to control movement of strut 136 to control lateral movement, i.e., toward and away from central axis 18.

Although not shown, an adjustable strut similar to strut 136 may be provided on track 212. Alternatively, tracks 212 and 214 may be provided with a cross-member similar to the cross-member of FIG. 3 to vary the location of luff cable 224.

Figure 13:
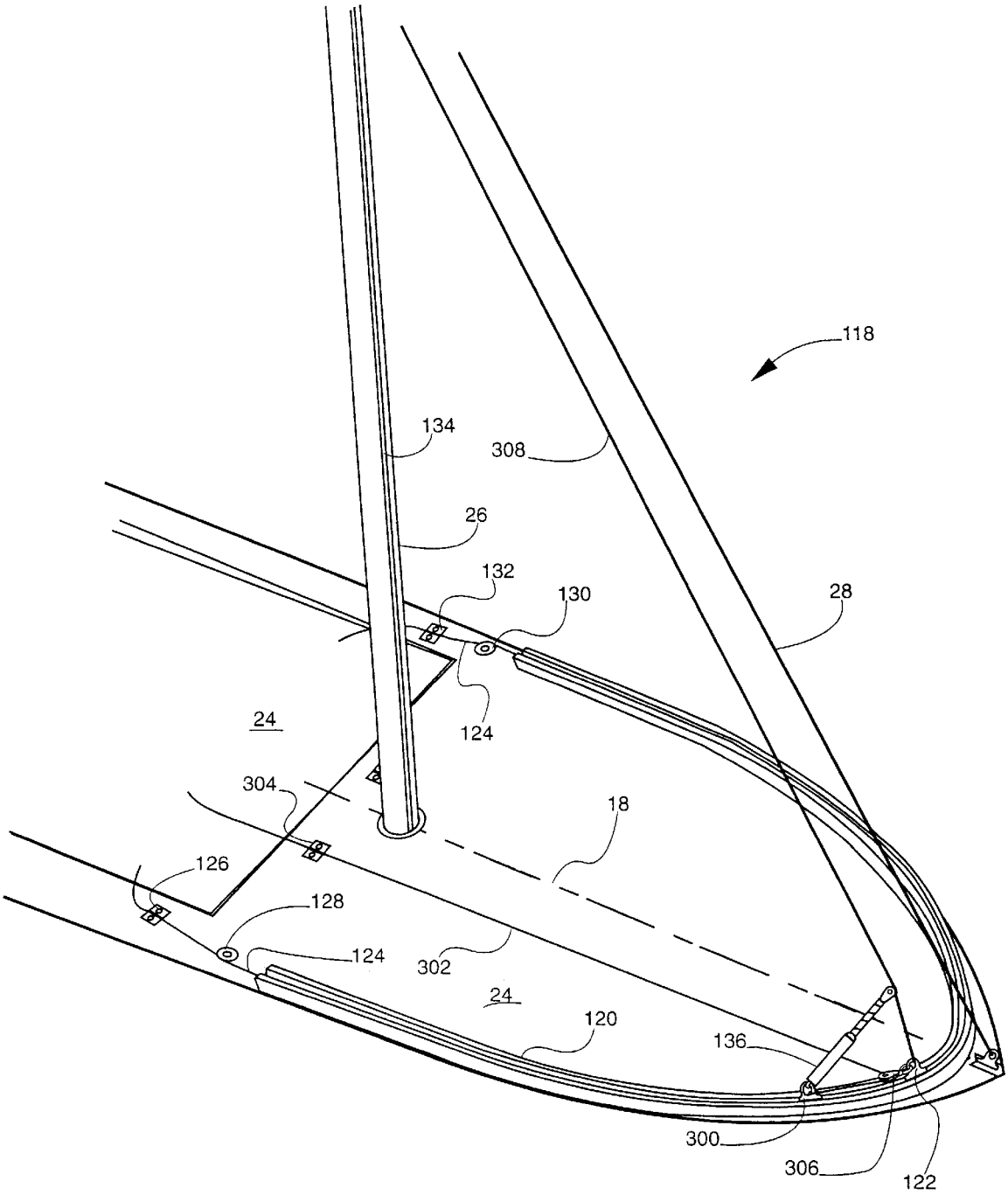
FIG. 13 illustrates the sailboat of FIG. 6 having an adjustable strut coupled to a deck track according to the invention.

As illustrated in FIG. 13, adjustable strut 136 may also be used with sailboat 118 of FIG. 6. To accommodate strut 136, a carriage 300 is coupled to track 120 and strut 136 is pivotally coupled to carriage 300. A control cable 302 which begins in cabin 24 extends past a cleat 304, around a pulley 306 and to carriage 300. In this way, a crew member may tighten or loosen cable 302 to vary the location of carriage 300 relative to carriage 122. In so doing, the crew member is able to adjust both the tension in and the orientation of a luff cable 308. Although not shown, carriage 300 (or another carriage) may be placed on the port side and operated with a separate control cable in a similar manner.

The invention has now been described in detail for purposes of clarity and understanding. However, it will be appreciated that certain changes and modifications may be made within the scope of the invention. Therefore, the scope and content of this invention are not limited by the foregoing description. Rather, the scope and content are to be defined by the following claims.

What is claimed is:

1. A sailboat comprising:

a hull;

a deck operably attached to the hull, the deck having a longitudinal axis extending along a center of the deck;

at least one mast generally aligned with the longitudinal axis;

a main sail operably coupled to the mast;

a single foresail having a head, a tack, and a clew, and a luff extending between the head and the tack, wherein the head is operably coupled to the mast, with the foresail being pivotable about the luff, and with the head and the tack being movable both toward and away from the longitudinal axis to permit the head and the tack to be moved to a windward side of the sailboat such that wind may engage the foresail and not be substantially blocked by the main sail when traveling downwind; and a system to move the head and the tack both toward and away from the longitudinal axis independent of the direction of the wind and independent of movement of the mainsail.

2. A sailboat as in claim 1, further comprising a luff cable coupled to the mast and the deck, the luff cable being movable relative to the longitudinal axis such that the luff cable is movable fore and aft, wherein at least a portion of the foresail is movable fore and aft upon movement of the luff cable.

3. A sailboat as in claim 2, wherein the foresail is coupled to the luff cable between the head and the tack.

4. A sailboat as in claim 3, wherein the luff cable is movably coupled to the deck to allow the tack to be movable toward and away from the longitudinal axis.

5. A sailboat as in claim 3, wherein the luff cable is movably coupled to the mast to allow the head to be movable toward and away from the longitudinal axis.

6. A sailboat as in claim 3, wherein the luff cable is movably coupled to the deck to allow the tack to be movable toward and away from the longitudinal axis, and wherein the luff cable is movably coupled to the mast to allow the head to be movable toward and away from the longitudinal axis.

7. A sailboat as in claim 2, further comprising a track operably attached to the deck, with at least a portion of the track being at an angle relative to the longitudinal axis, and wherein the luff cable is coupled to the track.

8. A sailboat as in claim 7, wherein the track is disposed about a periphery of the deck, and wherein the luff is coupled to the track by a carriage.

9. A sailboat as in claim 7, further comprising an adjustable strut coupled to the track, and wherein the adjustable strut engages the luff cable to adjust the orientation of the luff cable.

10. A sailboat as in claim 9, wherein the adjustable strut is coupled to the track by a carriage, and further comprising a control cable to adjust the location of the adjustable strut relative to the luff cable.

11. A sailboat as in claim 1, further comprising a track operably attached to the mast to raise and lower the head relative to the mast.

12. A sailboat as in claim 11, further comprising an adjustment mechanism coupled to the mast track to vary the location of the luff relative to the longitudinal axis.

13. A sailboat as in claim 12, wherein the adjustment mechanism comprises a cross member having a track to which the head may be operably coupled, and wherein the cross member is movably coupled to the mast track.

14. A sailboat as in claim 12, wherein the adjustment mechanism comprises a pivotable strut coupled to the mast track.

15. A sailboat as in claim 1, further comprising a pair of tracks aligned with and coupled to the mast and a pair of tracks disposed on the deck to permit said single foresail to be lowered and another foresail to be raised.

16. A sailboat as in claim 1, further comprising a headstay or a forestay extending from the mast to the deck, the headstay or the forestay being aligned with the longitudinal axis.

17. A sailboat comprising:

a hull;

a deck operably attached to the hull, the deck having a longitudinal axis extending along a center of the deck;

at least one mast generally aligned with the longitudinal axis;

a main sail operably coupled to the mast;

a single foresail having a head, a tack, and a clew, and a luff extending between the head and the tack, and wherein the head of the foresail is operably attached to the mast and the tack of the foresail is operably attached to the deck such that the head and the tack are movable relative to the longitudinal axis to permit the head and the tack to be moved to a windward side of the sailboat such that wind may engage the foresail and not be substantially blocked by the main sail when traveling downwind; and a system to move the head and the tack both toward and away from the longitudinal axis independent of the direction of the wind and independent of movement of the mainsail.

18. A sailboat as in claim 17, wherein the head is movable toward and away from the longitudinal axis.

19. A sailboat as in claim 17, wherein the foresail is operably attached to the deck such the tack is movable fore and aft, and wherein the clew is movable toward and away from the longitudinal axis.

20. A sailboat as in claim 17, further comprising a headstay or a forestay extending from the mast to the deck, the headstay or a forestay being aligned with the longitudinal axis.

21. A sailboat as in claim 17, further comprising a luff cable coupled to the mast and the deck, the luff cable being movable at least toward and away from the longitudinal axis, and wherein the foresail is coupled to the luff cable.

22. A sailboat as in claim 21, wherein the luff cable is further movable fore and aft.

23. A method for sailing a sailboat comprising a hull, a deck operably attached to the hull, the deck having a longitudinal axis extending along a center of the deck, at least one mast generally aligned with the longitudinal axis and a main sail operably coupled to the mast, the method comprising:

coupling a foresail having a head, a tack, a clew and a luff extending between the head and the tack to the mast, with the head and the tack being movable toward and away from the longitudinal axis;

positioning the sailboat downwind; and moving the head and the tack away from the longitudinal axis independent of any movement of the mainsail so that the foresail is moved to a windward side of the boat to permit the sailboat to sail downwind, with the wind engaging the foresail without substantial blockage by the mainsail.

24. A method as in claim 23, further comprising coupling the foresail to a luff cable between the head and the tack.

25. A method as in claim 24, further comprising moving the luff cable along the deck in a direction generally toward or away from the longitudinal axis to move the tack relative to the longitudinal axis.

26. A method as in claim 24, further comprising moving the luff cable generally toward or away from the mast to move the head relative to the longitudinal axis.

27. A method as in claim 24, further comprising coupling the luff cable to a track disposed on the deck and further comprising moving the cable along the deck track to raise the foresail.

28. A method as in claim 27, wherein the deck track begins near a cockpit of the sailboat to allow the luff cable to be coupled to the deck track from within the cockpit.

29. A method as in claim 27, further comprising coupling the luff cable to a track disposed on the mast and further comprising moving the cable along the mast track to raise the foresail.

30. A method as in claim 28, wherein the mast track begins near a cockpit of the sailboat to allow the luff cable to be coupled to the mast track from within the cockpit.

31. A sailboat comprising:

a hull;

a deck operably attached to the hull, the deck having a longitudinal axis extending along a center of the deck;

a mast generally aligned with the longitudinal axis;

at least two tracks disposed on the deck and on the mast, wherein each track is adapted to separately raise a foresail.

32. A sailboat as in claim 31, further comprising a luff cable coupled to each of the tracks, wherein each luff cable is coupled to one of the foresails, and wherein the foresail is raised by moving the luff cable along one of the deck tracks and up one of the mast tracks.

33. A sailboat as in claim 32, wherein the deck tracks are disposed on opposite sides of the longitudinal axis.

34. A sailboat as in claim 32, wherein at least a portion of the deck tracks are at an angle relative to the longitudinal axis such that the foresail is moveable toward and away from the longitudinal axis.

35. A sailboat as in claim 32, further comprising an adjustable strut which is movable along at least one of the mast tracks, wherein one of the luff cables is coupled to the strut to allow the luff cable to be movable toward and away from the mast.

36. A sailboat as in claim 32, further comprising a cross member which is movable along at least one of the mast tracks, wherein one of the luff cables is coupled to the cross member to allow the luff cable to be movable toward and away from the mast.

37. A method for operating a sailboat comprising a hull, a deck operably attached to the hull, the deck having a longitudinal axis extending along a center of the deck, a mast generally aligned with the longitudinal axis, and at least two tracks disposed on the deck and on the mast, the method comprising:

raising a first foresail by moving a first luff cable that is operably attached to the first foresail along a first one of the deck tracks and a first one of the mast tracks; and raising a second foresail by moving a second luff cable that is operably attached to the second foresail along a second one of the deck tracks and a second one of the mast tracks.

38. A method as in claim 37, further comprising raising the second foresail while the first foresail remains raised.

39. A method as in claim 37, further comprising lowering the first foresail while raising the second foresail.

40. A method as in claim 37, wherein the first and second foresails are raised by moving the first and second luff cables while remaining in a cockpit of the boat.

41. A method for retrofitting a sailboat to accommodate a foresail, the sailboat comprising a hull, a deck operably attached to the hull, the deck having a longitudinal axis extending along a center of the deck, a mast generally aligned with the longitudinal axis, the method comprising:

coupling a track to the deck and a track to the mast such that the foresail having a luff cable may be raised by moving the luff cable along the deck track and the mast track.

42. A method as in claim 41, further comprising coupling the deck track to the deck such that at least a portion of the deck track is at an angle relative to the longitudinal axis, whereby the foresail is moveable towards and away from the longitudinal axis.

43. A method as in claim 41, further comprising coupling at least two deck tracks to the deck and at least two mast tracks to the mast to allow two separate foresails to be separately raised and lowered.

* * * * *